US011471930B2

(12) United States Patent
Kuo

(10) Patent No.: US 11,471,930 B2
(45) Date of Patent: Oct. 18, 2022

(54) MOLDING DIE STRUCTURE FOR FORMING OBLIQUE TEETH ON A RIVET NUT

(71) Applicant: Wei In Enterprise Co., Ltd., Tainan (TW)

(72) Inventor: Ming-Che Kuo, Tainan (TW)

(73) Assignee: Wei In Enterprise Co., Ltd., Tainan (TW)

( * ) Notice: Subject to any disclaimer, the term of this patent is extended or adjusted under 35 U.S.C. 154(b) by 28 days.

(21) Appl. No.: 17/226,255

(22) Filed: Apr. 9, 2021

(65) Prior Publication Data

US 2022/0032360 A1 Feb. 3, 2022

(30) Foreign Application Priority Data

Jul. 30, 2020 (TW) ..... 109125697

(51) Int. Cl.
*B21J 13/02* (2006.01)
*B21K 1/60* (2006.01)
*B21K 1/70* (2006.01)

(52) U.S. Cl.
CPC ..... *B21J 13/02* (2013.01); *B21K 1/60* (2013.01); *B21K 1/70* (2013.01)

(58) Field of Classification Search
CPC ..... B21J 5/02; B21J 5/12; B21J 13/02; B21D 53/24; B21K 1/60; B21K 1/70; B21K 1/702; F16B 5/04; F16B 19/1072; F16B 37/067; F16B 37/068
USPC ..... 470/18, 20, 25, 26, 89, 91
See application file for complete search history.

(56) References Cited

U.S. PATENT DOCUMENTS 2,837,942 A * 6/1958 Howell ..... F16B 37/068 408/72 R
2,871,492 A * 2/1959 Sciullo ..... B21K 1/64 470/25
3,204,679 A * 9/1965 Walsh ..... F16B 37/068 411/180
7,387,575 B2 * 6/2008 Babej ..... B23P 19/062 470/25
9,248,503 B2 * 2/2016 Chiesa ..... B22F 5/085

FOREIGN PATENT DOCUMENTS

DE 102024002871 A1 * 9/2015 ..... B21J 13/02
DE 102018121175 A1 * 3/2020 ..... F16B 37/067
JP 3-243238 A * 10/1991 ..... B21J 5/02

* cited by examiner

*Primary Examiner* — Edward T Tolan
(74) *Attorney, Agent, or Firm* — Alan D. Kamrath; Karin L. Williams; Mayer & Williams PC

(57) ABSTRACT

A molding die structure for forming oblique teeth on a rivet nut includes a mold seat, a first forging die, a second forging die, and a retaining member. The mold seat is provided with a mold cavity and a threaded portion. The first forging die is inserted into the mold cavity and provided with a die cavity and a nut cavity. The second forging die is inserted into the die cavity and has an inner face provided with an oblique toothed portion and a guide hole. The oblique toothed portion includes a plurality of oblique teeth. The retaining member is screwed into the threaded portion and limits the first forging die and the second forging die in the mold cavity. The second forging die and the die cavity of the first forging die form a low friction contact.

5 Claims, 5 Drawing Sheets

MOLDING DIE STRUCTURE FOR FORMING OBLIQUE TEETH ON A RIVET NUT

BACKGROUND OF THE INVENTION

1. Field of the Invention

The present invention relates to a nut working (or molding) machine and, more particularly, to a molding die structure for forming oblique teeth on a rivet nut.

2. Description of the Related Art

A rivet nut is available for a metal sheet plate. The rivet nut is combined with an anchor hole of the metal sheet plate after the rivet nut is pressed and riveted. Thus, the rivet nut is screwed onto a bolt for use with an operator. A conventional rivet nut 10 in accordance with the prior art shown in FIG. 1 comprises a nut body 11, a flange 12 and a screw hole 13. The flange 12 is provided with a plurality of oblique teeth 14. The screw hole 13 extends through the nut body 11 and the flange 12. Thus, the oblique teeth 14 increases the friction between the rivet nut 10 and the metal sheet plate, to prevent the rivet nut 10 from being rotated freely, and to prevent the rivet nut 10 from being removed axially from the metal sheet plate. A conventional nut molding machine is used to form the rivet nut. The nut blank is worked by a couple of forging and molding procedures to form a rivet nut with a flange which is formed with teeth. However, the forging actions of the nut molding machine are performed in the axial direction, so that the flange of the rivet nut is formed with straight teeth. If a conventional nut molding machine cooperates with a conventional die structure to forge the rivet nut and to form oblique teeth on the flange of the rivet nut, the oblique teeth cannot be stripped from the die structure. The rivet nut or the die structure is easily damaged when the oblique teeth is forcibly removed from the die structure. Thus, the oblique teeth cannot be directly formed on the flange of the rivet nut during the working process, so that it is necessary to provide a secondary working process, such as knurling or the like, to form the oblique teeth on the flange of the rivet nut, thereby complicating the working procedure, increasing the working time, and greatly decreasing yield of the rivet nut.

BRIEF SUMMARY OF THE INVENTION

The primary objective of the present invention is to provide a molding die structure for directly forming oblique teeth on a rivet nut by a nut molding machine during a successive molding and forming process of the rivet nut, to enhance the efficiency of production.

In accordance with the present invention, there is provided a molding die structure for forming oblique teeth on a rivet nut comprising a mold seat, a first forging die, a second forging die, and a retaining member. The mold seat is provided with a mold cavity. The mold cavity is provided with a threaded portion. The first forging die is inserted into the mold cavity of the mold seat. The first forging die is provided with a die cavity and a nut cavity. The nut cavity is connected to the die cavity. The first forging die has an oblique shoulder formed between the nut cavity and the die cavity. The second forging die is inserted into the die cavity of the first forging die. The second forging die has a hollow cylindrical shape. The second forging die has a front end provided with an oblique resting face. The second forging die has an inner face provided with an oblique toothed portion and a guide hole. The oblique toothed portion is connected to the guide hole. The oblique toothed portion includes a plurality of oblique teeth. The retaining member is screwed into the threaded portion of the mold seat and limits the first forging die and the second forging die in the mold cavity of the mold seat. The second forging die and the die cavity of the first forging die form a low friction contact.

Preferably, the oblique resting face of the second forging die has a slope corresponding to that of the oblique shoulder of the first forging die.

Preferably, the second forging die has an outer wall in non-contact with an inner wall of the die cavity of the first forging die.

Preferably, the second forging die has a height less than a depth of the die cavity of the first forging die. The height of the second forging die is more than 99.5% of the depth of the die cavity of the first forging die.

Preferably, each of the oblique teeth has an inclined angle ranged between 35° and 45°.

According to the primary advantage of the present invention, the molding die structure cooperates with the nut working machine to work the rivet nut so that the flange of the rivet nut is directly formed with the oblique teeth during the working process.

According to another advantage of the present invention, the flange of the rivet nut is directly formed with the oblique teeth without needing a secondary working process, thereby simplifying the working procedure, shortening the working time, and greatly increasing yield of the rivet nut.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
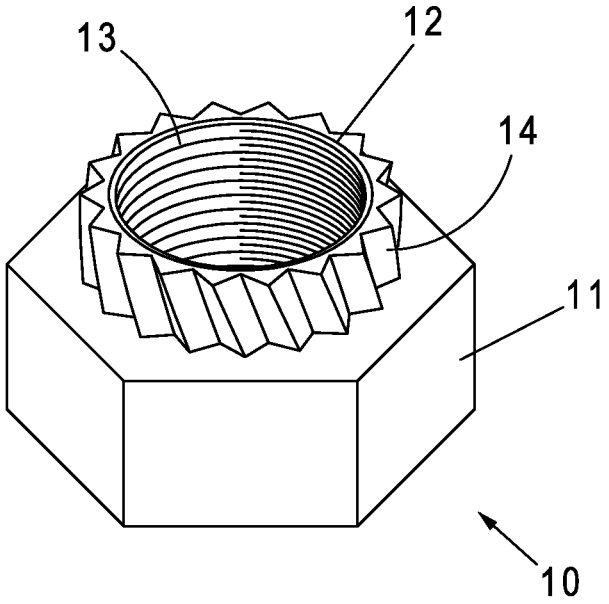
FIG. 1 PRIOR ART
FIG. 1 is a perspective view of a conventional rivet nut in accordance with the prior art.
Figure 2:
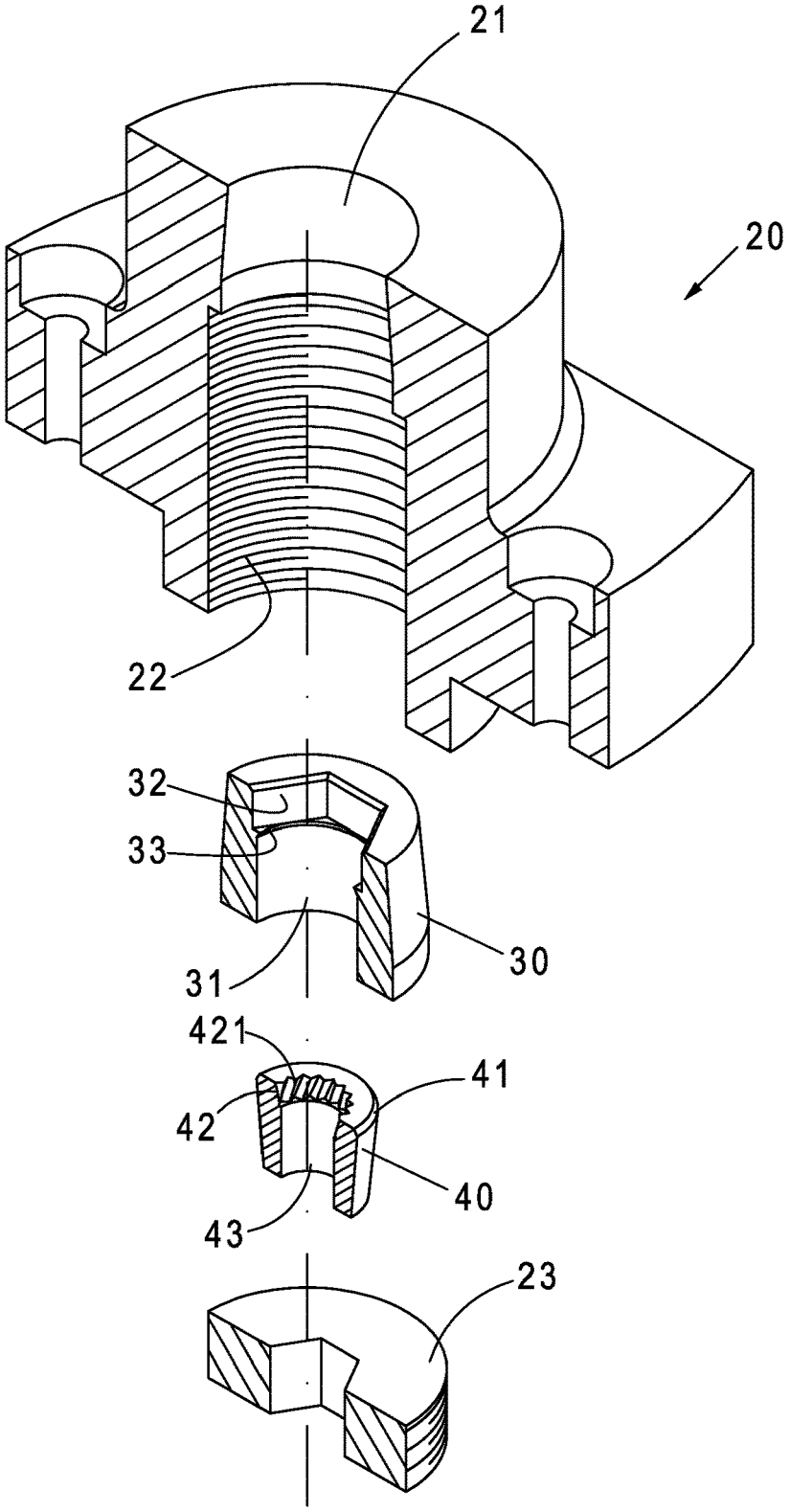
FIG. 2 is an exploded perspective view of a molding die structure in accordance with the preferred embodiment of the present invention.
Figure 3:
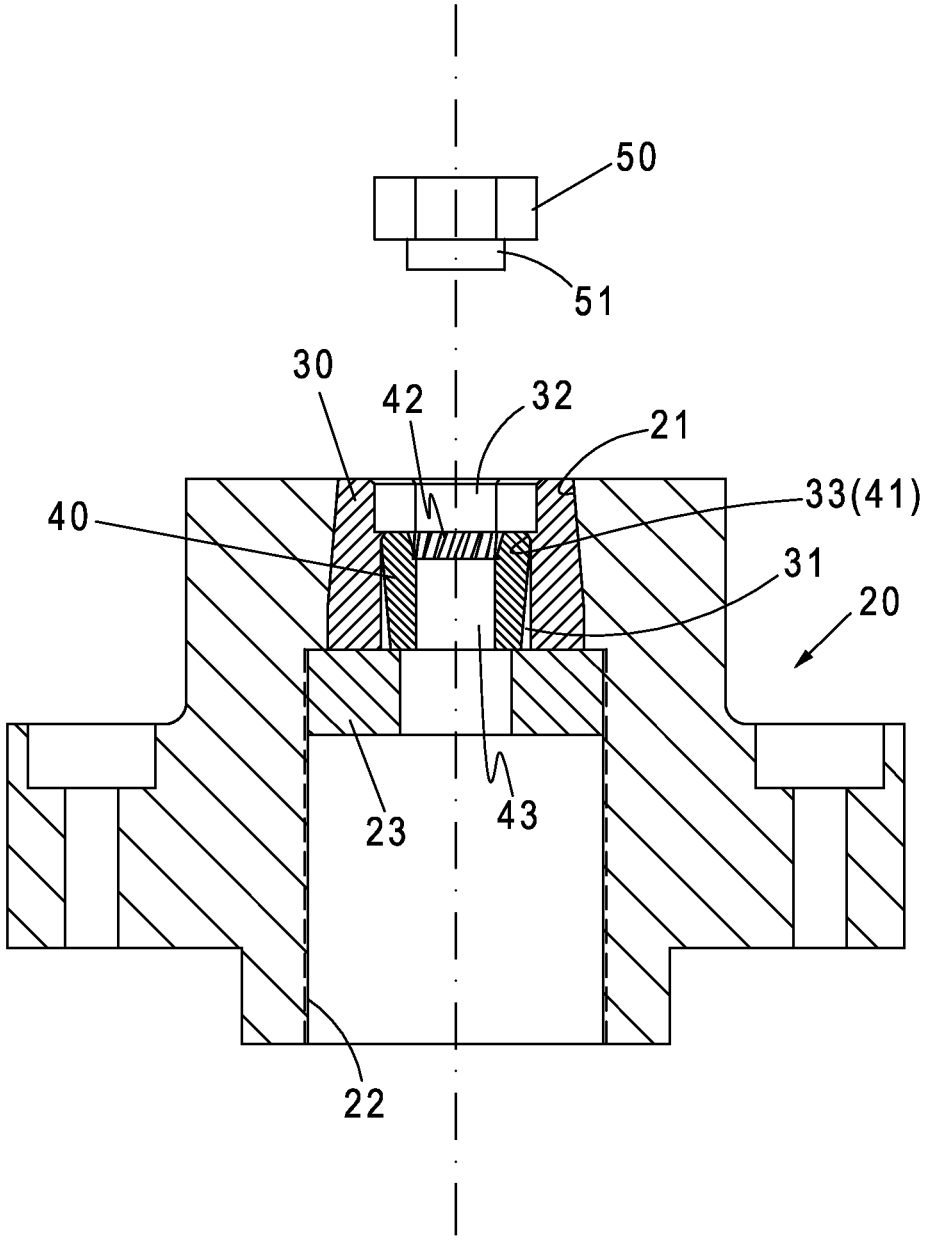
FIG. 3 is a front cross-sectional view of the molding die structure in accordance with the preferred embodiment of the present invention.

Referring to the drawings and initially to FIGS. 2 and 3, a molding die structure for forming oblique teeth on a rivet nut in accordance with the preferred embodiment of the present invention comprises a mold seat 20, a first forging (or stamping) die 30, a second forging (or stamping) die 40, and a retaining member 23.

The mold seat 20 is provided with a mold cavity 21. The mold cavity 21 of the mold seat 20 is used to receive the first forging die 30 and the second forging die 40. The mold cavity 21 is provided with a threaded portion 22.

The first forging die 30 is inserted into the mold cavity 21 of the mold seat 20. The first forging die 30 is provided with a die cavity 31 and a nut cavity 32. The die cavity 31 receives the second forging die 40. The nut cavity 32 is connected to the die cavity 31. The first forging die 30 has an oblique shoulder 33 formed between the nut cavity 32 and the die cavity 31.

The second forging die 40 is inserted into and loosely fitted in the die cavity 31 of the first forging die 30. The second forging die 40 has a hollow cylindrical shape. The second forging die 40 has a front end provided with an oblique resting face 41. The second forging die 40 has an inner face provided with an oblique toothed portion (or grain portion or pattern portion) 42 and a guide hole 43. The oblique toothed portion 42 is connected to the guide hole 43. The oblique toothed portion 42 includes a plurality of oblique teeth 421.

The retaining member 23 is screwed into the threaded portion 22 of the mold seat 20 and limits the first forging die 30 and the second forging die 40 in the mold cavity 21 of the mold seat 20. Thus, the second forging die 40 and the die cavity 31 of the first forging die 30 form a low friction contact.

In the preferred embodiment of the present invention, the oblique resting face 41 of the second forging die 40 has a slope corresponding to that of the oblique shoulder 33 of the first forging die 30.

In the preferred embodiment of the present invention, the second forging die 40 has an outer wall in non-contact with an inner wall of the die cavity 31 of the first forging die 30.

In the preferred embodiment of the present invention, the outer wall of the second forging die 40 is tapered from the oblique resting face 41 to the rear end of the second forging die 40 through 5°.

In the preferred embodiment of the present invention, the second forging die 40 has a height less than a depth of the die cavity 31 of the first forging die 30. Preferably, the height of the second forging die 40 is more than 99.5% of the depth of the die cavity 31 of the first forging die 30. Thus, the second forging die 40 and the die cavity 31 of the first forging die 30 form a low friction connection.

In the preferred embodiment of the present invention, each of the oblique teeth 421 has an inclined angle ranged between 35° and 45°.

In the preferred embodiment of the present invention, the second forging die 40 has a shape corresponding to that of the die cavity 31 of the first forging die 30, with a tolerance defined therebetween.

In the preferred embodiment of the present invention, the threaded portion 22 of the mold seat 20 is close to an open end of the mold cavity 21.

In the preferred embodiment of the present invention, the retaining member 23 is provided with an external thread screwed into the threaded portion 22 of the mold seat 20.

Figure 4:
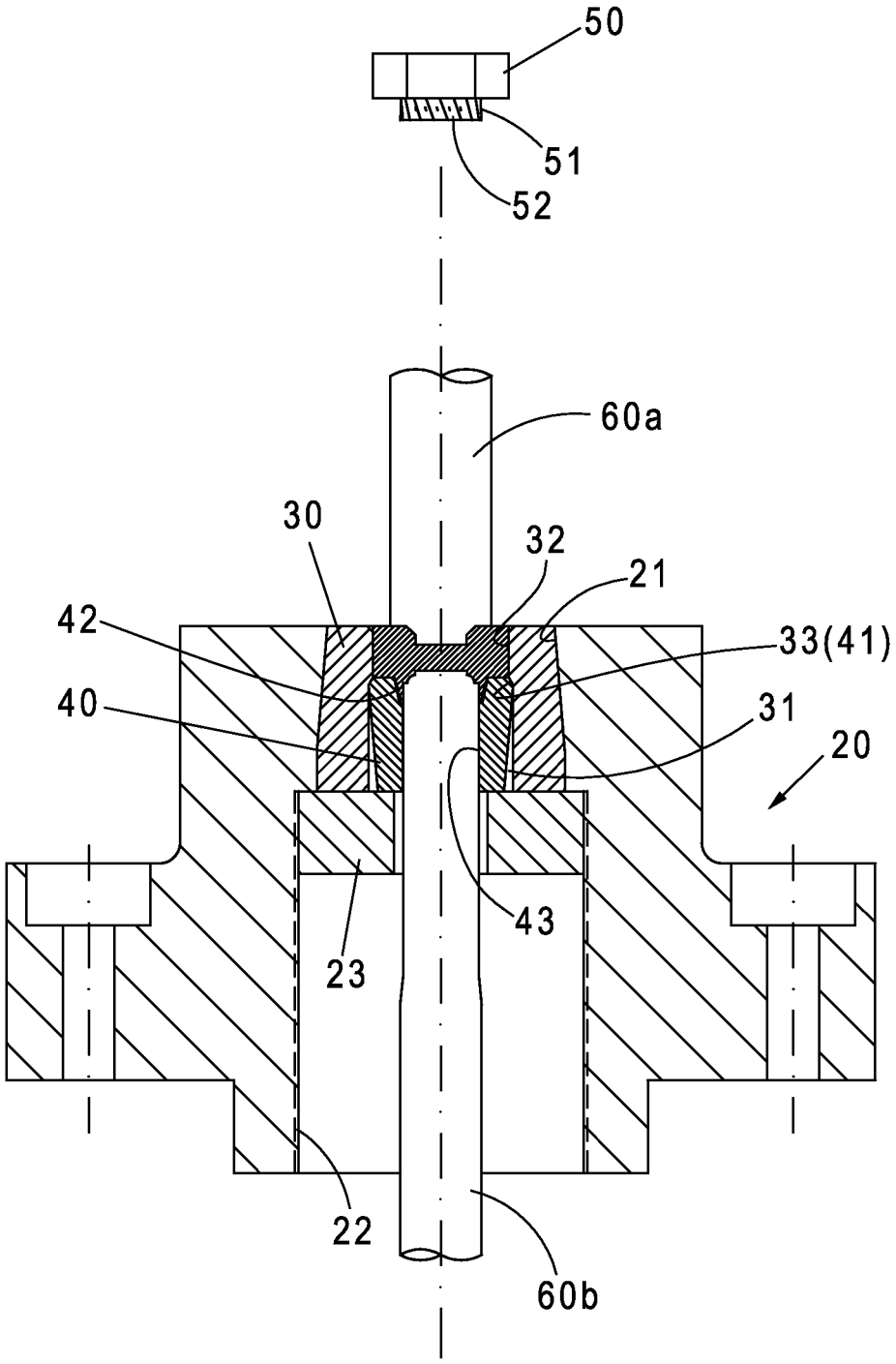
FIG. 4 is a front cross-sectional operational view of the molding die structure showing that the flange of the rivet nut is pressed to form the oblique teeth, and the rivet nut is pushed out of the nut cavity of the first forging die.
Figure 5:
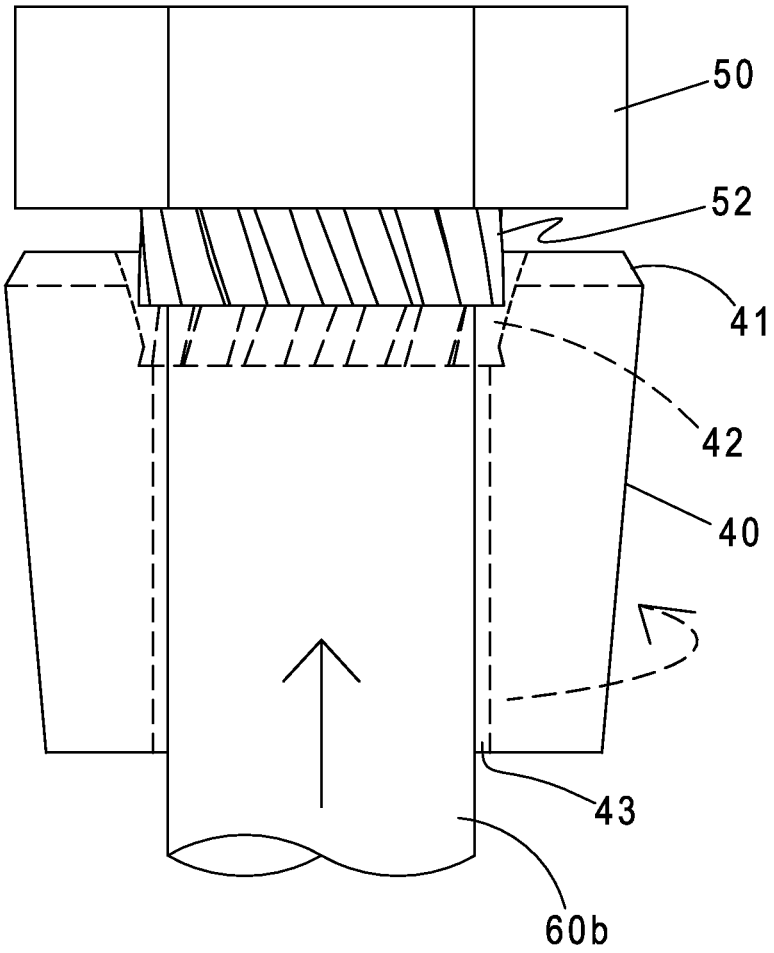
FIG. 5 is a schematic operational view of the molding die structure showing that the second forging die performs a rotation when the rivet nut is pushed by the rear punch head.

In operation, referring to FIGS. 4 and 5 with reference to FIGS. 2 and 3, the molding die structure is used to cooperate with a nut working machine to work and forge a rivet nut (or nut blank) 50. The nut working machine includes a front punch head (or ram) 60*a* and a rear punch head (or ram) 60*b*. The rivet nut 50 is provided with a flange 51. The rivet nut 50 is initially placed into the nut cavity 32 of the first forging die 30 by a conveyor and rests on the second forging die 40. The forging and pressing process includes two steps. In the first step, the rivet nut 50 is located between the front punch head 60*a* and the rear punch head 60*b*. In such a manner, the front punch head 60*a* and the rear punch head 60*b* compress the rivet nut 50 simultaneously so that the flange 51 of the rivet nut 50 is forced into the oblique toothed portion 42 of the second forging die 40 and pressed by the oblique teeth 421 of the oblique toothed portion 42, thereby forming a plurality of oblique teeth 52 on the periphery of the flange 51. Thus, the rivet nut 50 is compressed and squeezed by the front punch head 60*a* and the rear punch head 60*b* so that the flange 51 of the rivet nut 50 is formed with the oblique teeth 52 by action of the oblique teeth 421 of the second forging die 40. In the second step, the front punch head 60*a* is removed from the mold seat 20 to release the rivet nut 50, and the rear punch head 60*b* is moved upward to push the rivet nut 50 out of the nut cavity 32 of the first forging die 30.

When the rivet nut 50 is pushed out of the nut cavity 32 of the first forging die 30 by the rear punch head 60*b*, the rivet nut 50 is not rotated during operation. At this time, the second forging die 40 and the die cavity 31 of the first forging die 30 form a low friction contact. Thus, the second forging die 40 easily performs a rotation with the slope of the oblique teeth 421 of the oblique toothed portion 42 as shown in FIG. 5, so that the flange 51 of the rivet nut 50 is removed from the second forging die 40 easily. In such a manner, the rivet nut 50 is worked by the nut working machine so that the flange 51 of the rivet nut 50 is directly formed with the oblique teeth 52. In addition, the oblique teeth 52 of the rivet nut 50 and the oblique toothed portion 42 of the second forging die 40 will not be damaged during the working process.

Accordingly, the molding die structure cooperates with the nut working machine to work the rivet nut 50 so that the flange 51 of the rivet nut 50 is directly formed with the oblique teeth 52 during the working process. In addition, the flange 51 of the rivet nut 50 is directly formed with the oblique teeth 52 without needing a secondary working process, thereby simplifying the working procedure, shortening the working time, and greatly increasing yield of the rivet nut 50.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A molding die structure for forming oblique teeth on a rivet nut comprising:

a mold seat, a first forging die, a second forging die, and a retaining member;

wherein:

the mold seat is provided with a mold cavity;

the mold cavity is provided with a threaded portion;

the first forging die is inserted into the mold cavity of the mold seat;

the first forging die is provided with a die cavity and a nut cavity;

the nut cavity is connected to the die cavity;

the first forging die has an oblique shoulder formed between the nut cavity and the die cavity;

the second forging die is inserted into the die cavity of the first forging die;

the second forging die has a hollow cylindrical shape;

the second forging die has a front end provided with an oblique resting face;

the second forging die has an inner face provided with an oblique toothed portion and a guide hole;

the oblique toothed portion is connected to the guide hole;

the oblique toothed portion includes a plurality of oblique teeth;

the retaining member is screwed into the threaded portion of the mold seat and limits the first forging die and the second forging die in the mold cavity of the mold seat; and the second forging die and the die cavity of the first forging die form a low friction contact.

2. The molding die structure for forming oblique teeth on a rivet nut as claimed in claim 1, wherein the oblique resting face of the second forging die has a slope corresponding to that of the oblique shoulder of the first forging die.

3. The molding die structure for forming oblique teeth on a rivet nut as claimed in claim 1, wherein the second forging die has an outer wall in non-contact with an inner wall of the die cavity of the first forging die.

4. The molding die structure for forming oblique teeth on a rivet nut as claimed in claim 1, wherein:

the second forging die has a height less than a depth of the die cavity of the first forging die; and the height of the second forging die is more than 99.5% of the depth of the die cavity of the first forging die.

5. The molding die structure for forming oblique teeth on a rivet nut as claimed in claim 1, wherein each of the oblique teeth has an inclined angle ranged between 35° and 45°.

* * * * *